US011120724B2

(12) United States Patent
Kim

(10) Patent No.: US 11,120,724 B2
(45) Date of Patent: Sep. 14, 2021

(54) DISPLAY DEVICE AND DRIVING METHOD THEREOF

(71) Applicant: LG Display Co., Ltd., Seoul (KR)

(72) Inventor: Daeyong Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/122,673

(22) Filed: Dec. 15, 2020

(65) Prior Publication Data

US 2021/0201740 A1 Jul. 1, 2021

(30) Foreign Application Priority Data

Dec. 31, 2019 (KR) ..... 10-2019-0180156

(51) Int. Cl.
*G09G 3/20* (2006.01)

(52) U.S. Cl.
CPC ..... *G09G 3/20* (2013.01); *G09G 2310/0275* (2013.01); *G09G 2310/0297* (2013.01); *G09G 2310/08* (2013.01)

(58) Field of Classification Search
CPC ..... G09G 2310/0297; G09G 3/20; G09G 2310/08; G09G 5/008
See application file for complete search history.

(56) References Cited

U.S. PATENT DOCUMENTS

2006/0238134 A1* 10/2006 Park ..... G09G 3/3241 315/169.3
2015/0145901 A1* 5/2015 Lee ..... G09G 3/3614 345/691
2019/0302873 A1* 10/2019 Chen ..... G06F 1/3265
2019/0362666 A1* 11/2019 Chen ..... G09G 3/20
2020/0394953 A1* 12/2020 Kim ..... H05B 45/325

FOREIGN PATENT DOCUMENTS

KR 10-2019-0080065 A 7/2019

* cited by examiner

*Primary Examiner* — Gerald Johnson
(74) *Attorney, Agent, or Firm* — Birch, Stewart, Kolasch & Birch, LLP

(57) ABSTRACT

Provided are a display device and a driving method thereof. The display device includes a display panel including a plurality of pixels defined by allowing a plurality of gate lines and a plurality of data lines to intersect each other; a timing controller generating a gate control signal, a data control signal, a MUX clock signal, and image data; a gate driving circuit sequentially providing gate signals to the plurality of gate lines based on the gate control signal; a data driving circuit supplying a data signal to the plurality of data lines based on the image data and the data control signal to drive the pixels; and a MUX circuit receiving the data signal and outputting the data signal in a time division manner to the data lines according to the MUX clock signal. The timing controller includes a slew rate control unit controlling a slew rate of the MUX clock signal.

8 Claims, 8 Drawing Sheets

DISPLAY DEVICE AND DRIVING METHOD THEREOF

CROSS REFERENCE TO RELATED APPLICATIONS

The application claims the priority benefit of Korean Patent Application No. 10-2019-0180156, filed on Dec. 31, 2019 in the Republic of Korea, the entire contents of which are hereby expressly incorporated herein by reference for all purposed as if fully set forth herein into the present application.

BACKGROUND OF THE INVENTION

Field of the Invention

The present disclosure relates generally to a display device and a driving method thereof.

Description of the Related Art

As information society develops, various types of display devices have been developed. Recently, various display devices such as a liquid crystal display (LCD), a plasma display panel (PDP), and an organic light emitting display (OLED) have been used.

The display device includes a plurality of pixels generated by making a plurality of gate lines and a plurality of data lines intersect each other. The plurality of pixels operates according to a data signal received through the plurality of data lines. Herein, it is required to reduce the number of data lines in the output terminal of the data signal, for the purpose of miniaturization and high resolution of the display device.

To this end, it is possible to reduce the number of lines needed to transmit the data signal by connecting a multiplexer (MUX) to the plurality of data lines and transmitting the data signals to pixels in a time division manner.

The MUX includes a circuit element that is triggered by a MUX clock signal that transitions at a high rate. The circuit element selects at least one of a plurality of input signals and outputs the same to the output terminal. However, in order to reduce an electromagnetic interference (EMI) noise of the display device, a method of adjusting a slew rate of the MUX clock signal has been proposed.

SUMMARY OF THE INVENTION

An objective of this disclosure is to provide a display device capable of effectively removing EMI noise by controlling a slew rate of a MUX clock signal.

Another objective of the present invention is to provide a method of driving a display device capable of effectively removing EMI noise by controlling a slew rate of a MUX clock signal.

The objectives of the present invention are not limited to those mentioned above, and other objectives not mentioned will be clearly understood by those skilled in the art from the following description.

In order to achieve the above objectives, a display panel according to embodiments of the present disclosure includes a display panel including a plurality of pixels defined by allowing a plurality of gate lines and a plurality of data lines to intersect each other; a timing controller generating a gate control signal, a data control signal, a MUX clock signal, and image data; a gate driving circuit sequentially providing gate signals to the plurality of gate lines based on the gate control signal; a data driving circuit supplying a data signal to the plurality of data lines based on the image data and the data control signal to drive the plurality of pixels; and a MUX circuit receiving the data signal and outputting the data signal in a time division manner to the plurality of data lines according to the MUX clock signal, wherein the timing controller includes a slew rate control unit that controls a slew rate of the MUX clock signal, in which the slew rate control unit includes a rising slew rate control unit controlling the slew rate in a rising section of the MUX clock signal, and a falling slew rate control unit controlling the slew rate in a falling section of the MUX clock signal.

According to an embodiment of the present disclosure, the MUX clock signal can include a positive MUX clock signal and a negative MUX clock signal that is complementary to the positive MUX clock signal; and the MUX circuit can include a plurality of transmission gates that are switched according to the positive MUX clock signal and the negative MUX clock signal.

According to an embodiment of the present disclosure, the rising slew rate control unit can include a first circuit controlling the slew rate in a rising section of the positive MUX clock signal; and a second circuit controlling the slew rate in a rising section of the negative MUX clock signal, and the falling slew rate control unit can include a third circuit controlling the slew rate in a falling section of the positive MUX clock signal; and a fourth circuit controlling the slew rate in a falling section of the negative MUX clock signal.

According to an embodiment of the present disclosure, the timing controller can measure a first intersection point and a second intersection point at which the positive MUX clock signal and the negative MUX clock signal intersect each other; and control the slew rate in the rising section and the slew rate in the falling section of the positive MUX clock signal, and the slew rate in the rising section and the slew rate in the falling section of the negative MUX clock signal, so that the first intersection point and the second intersection point meet at the same voltage.

According to an embodiment of the present disclosure, the slew rate control unit can include a high potential voltage line and a low potential voltage line arranged side by side; at least one first transistor pulling up an output terminal to the high potential voltage according to a first switching signal; and at least one second transistor pulling down the output terminal to the low potential voltage according to a second switching signal.

In order to achieve the above object, a method of driving a display panel according to an embodiment of the present disclosure includes generating a gate control signal, a data control signal, and a MUX clock signal; generating a data signal provided to a plurality of data lines based on the data control signal; providing the data signal to a MUX circuit; outputting the data signal in a time division manner based on the MUX clock signal; and controlling a slew rate at a rising time and a slew rate at a falling time of the MUX clock signal to be provided to the MUX circuit.

According to an embodiment of the present disclosure, the MUX clock signal can include a positive MUX clock signal and a negative MUX clock signal that is complementary to the positive MUX clock signal; and the MUX circuit can include a plurality of transmission gates that are switched according to the positive MUX clock signal and the negative MUX clock signal.

According to an embodiment of the present disclosure, the method can further include measuring a first intersection point and a second intersection point at which the positive MUX clock signal and the negative MUX clock signal intersect each other; and controlling a slew rate in a rising section and a slew rate in the falling section of the positive MUX clock signal, and a slew rate in the rising section and a slew rate in the falling section of the negative MUX clock signal, so that the first intersection point and the second intersection point meet at the same voltage.

The display device according to embodiments of the present invention includes slew rate control units, each of which changes a time constant of a circuit included therein according to a turn-on state of a transistor included therein. Therefore, the slew rate of the MUX clock signal output from the included circuit can be controlled.

In addition, the slew rate control units include a total of four circuits, such as a slew rate in a rising or falling section of the positive MUX clock signal, and a slew rate in a rising or falling section of the negative MUX clock signal, to control the slew rate of each of the negative MUX and the positive MUX clock signal, thereby effectively avoiding EMI noise caused due to the MUX clock signal.

The effects of the present invention are not limited to the effects mentioned above, and other effects not mentioned will become apparent to those skilled in the art from the description of the claims.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention. In the drawings.

DETAILED DESCRIPTION OF THE EMBODIMENTS

Figure 1:
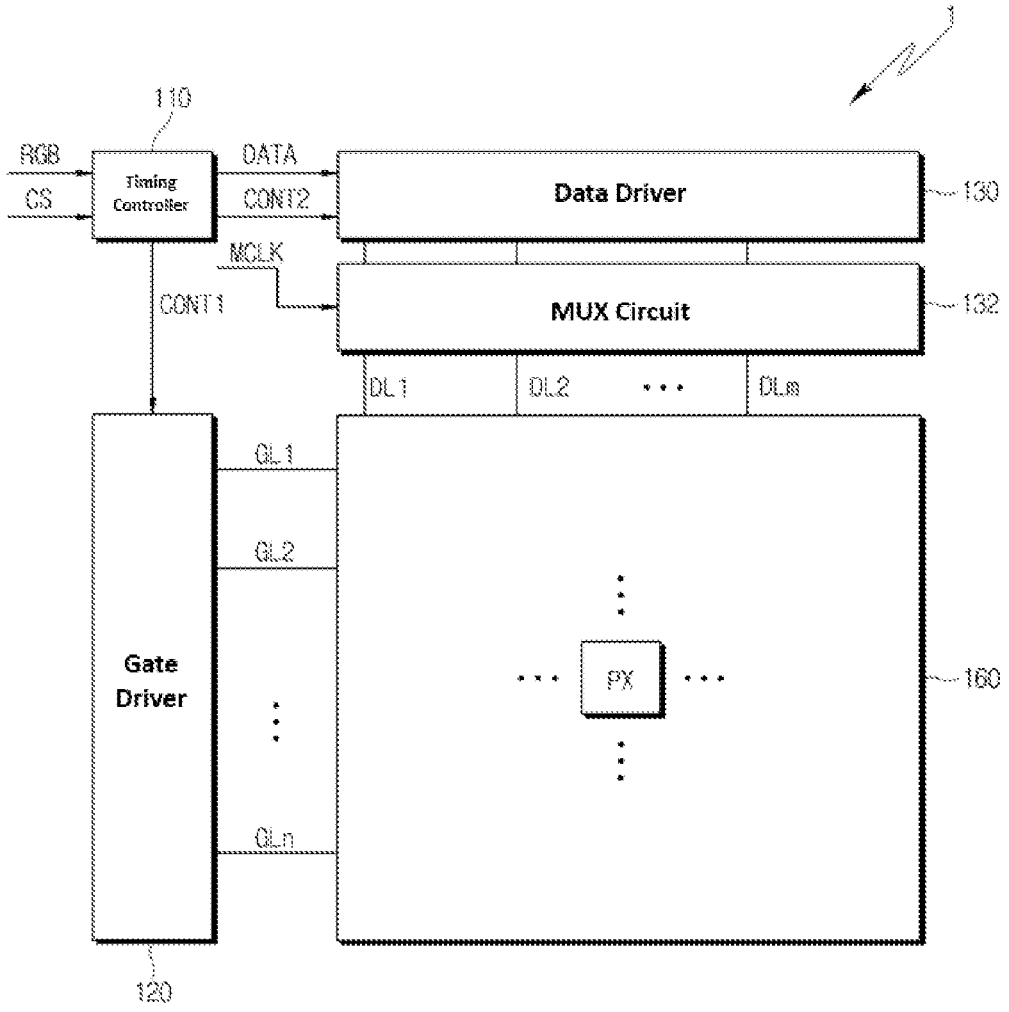
FIG. 1 is a block diagram illustrating a configuration of a display device according to an embodiment of the present disclosure.

Hereinafter, various embodiments will be described with reference to the drawings. In this specification, when a component (or region, layer, part, etc.) is referred to as being "on", "connected" to, or "joined" to another component, it means that the component can be directly connected/coupled to another component or the component can be connected/coupled to another component with a third component in between.

The same reference numbers refer to the same components. In addition, in the drawings, the thickness, ratio, and dimensions of the components are exaggerated for effective description of technical content. Terms "and/or" include one or more combinations capable of being defined by associated configurations.

Terms such as "first" and "second" can be used to describe various components, but the components are not limited by the terms. The terms are used only for the purpose of distinguishing one component from other components and may not define order. For example, the first component can be referred to as a second component without departing from the scope of rights of various embodiments, and similarly, the second component can also be referred to as a first component. Singular expressions include plural expressions unless the context clearly indicates otherwise.

The terms such as "below", "lower", "above", "upper", etc. are used to describe the association of the components shown in the drawings. The terms are relative concepts and are explained on the basis of the directions indicated in the drawings.

It should be understood that terms such as "comprise" or "have" is intended to designate the presence of features, numbers, steps, operations, components, parts or combinations thereof described in the specification, but not to exclude the possibility of the presence or addition of one or more other features or numbers, steps, operations, components, parts, or combinations thereof. Further, the term "clock" encompasses clock signal(s).

FIG. 1 is a block diagram illustrating a configuration of a display device according to an embodiment of the present disclosure. All components of the display device according to all embodiments of the present disclosure are operatively coupled and configured.

Referring to FIG. 1, a display device 1 can include a timing controller 110, a gate driver 120, a data driver 130, a MUX circuit 132, and a display panel 160.

The timing controller 110 can receive an image signal RGB and a control signal CS from the outside. The image signal RGB can include a plurality of pieces of gradation data. The control signal CS can include, for example, a horizontal synchronization signal, a vertical synchronization signal, and a main clock signal.

The timing controller 110 processes the image signal RGB and the control signal CS in such a manner as to be suitable for operating the conditions of the display panel 160, to output an image data DATA, a gate driving control signal CONT1, and a data driving control signal CONT2.

In addition, the timing controller 110 according to an embodiment of the present invention can generate a MUX clock MCLK (e.g., clock signals) for controlling the MUX circuit 132. The timing controller 110 can include slew rate control units 201 to 204 each that adjust a slew rate of the generated MUX clock MCLK. The generated MUX clock MCLK can be provided to the MUX circuit 132. The MUX clock MCLK can include, for example, a positive MUX clock and a negative MUX clock, which are complementary to each other.

The gate driver 120 can be connected to pixels PX of the display panel 160 through a plurality of gate lines GL1 to GLn, where n is a positive number such as a positive integer. The gate driver 120 can generate gate signals on the basis of the gate driving control signal CONT1 output from the timing controller 10. The gate driver 120 can provide the generated gate signals to the pixels PX through the plurality of gate lines GL1 to GLn.

The data driver 130 can be connected to the pixels PXs of the display panel 160 through a plurality of data lines DL1 to DLm, where m is a positive number such as a positive integer. The data driver 130 can generate data signals on the basis of the image data DATA and data driving control signal CONT2 output from the timing controller 10. The data driver 130 can provide the generated data signals to the pixels PXs through the plurality of data lines DL1 to DLm.

In FIG. 1, the gate driver 120 and the data driver 130 are shown as separate components from the display panel 160, but at least one of the gate driver 120 and the data driver 130 can be configured in an in-panel manner as to be integrally formed with the display panel 160. For example, the gate driver 120 can be integrally formed with the display panel 160 according to a gate in panel (GIP) method. Other configurations are possible for the gate driver 120 and the data driver 130.

The MUX circuit 132 can be disposed between the data driver 130 and the display panel 160. The MUX circuit 132 can include a plurality of switches to be switched by a MUX clock provided from the timing controller 110. In this regard, it will be described in more detail with reference to FIG. 2.

Figure 2:
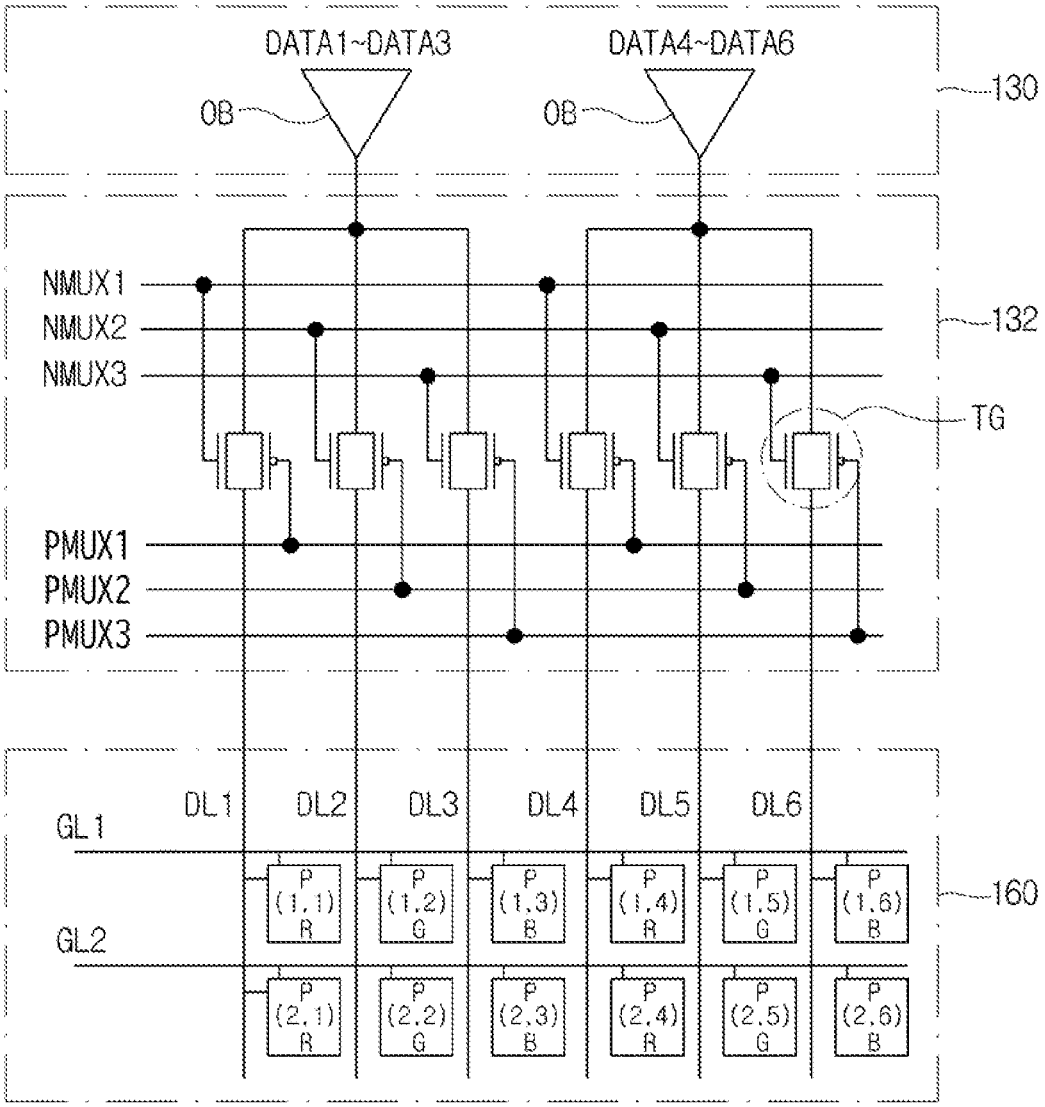
FIG. 2 is a circuit diagram specifically illustrating a data driver, a MUX circuit, and a display panel shown in FIG. 1.

FIG. 2 is a circuit diagram specifically illustrating an example of the data driver, the MUX circuit, and the display panel shown in FIG. 1.

Referring to FIG. 2, the MUX circuit 132 controlled by first to third negative MUX clocks NMUX1 to NMUX3 and first to third positive MUX clocks PMUX1 to PMUX3 provided by the timing controller 110 is shown.

The transmission gates TG of the MUX circuit 132 are turned on by the first to third negative MUX clocks NMUX1 to NMUX3 and the first to third positive MUX clocks PMUX1 to PMUX3, respectively, so that first to third data signals DATA1 to DATA3 are transmitted in a time division manner to first to third data lines DL1 to DL3 of the touch display panel 160, and fourth to sixth data signals DATA4 to DATA6 are transmitted in a time division manner to fourth to sixth data lines DL4 to DL6 of the touch display panel 160.

For example, when driving the pixel P(1, 1), a gate driving signal having a magnitude of a turn-on voltage is transmitted to the first gate line GL1, the first negative MUX clock NMUX1 transitions to a high level, and the first positive MUX clock PMUX1 transitions to a low level, whereby the data signal can be provided from the data driving circuit 130 to the pixel P(1, 1).

Figure 3A:
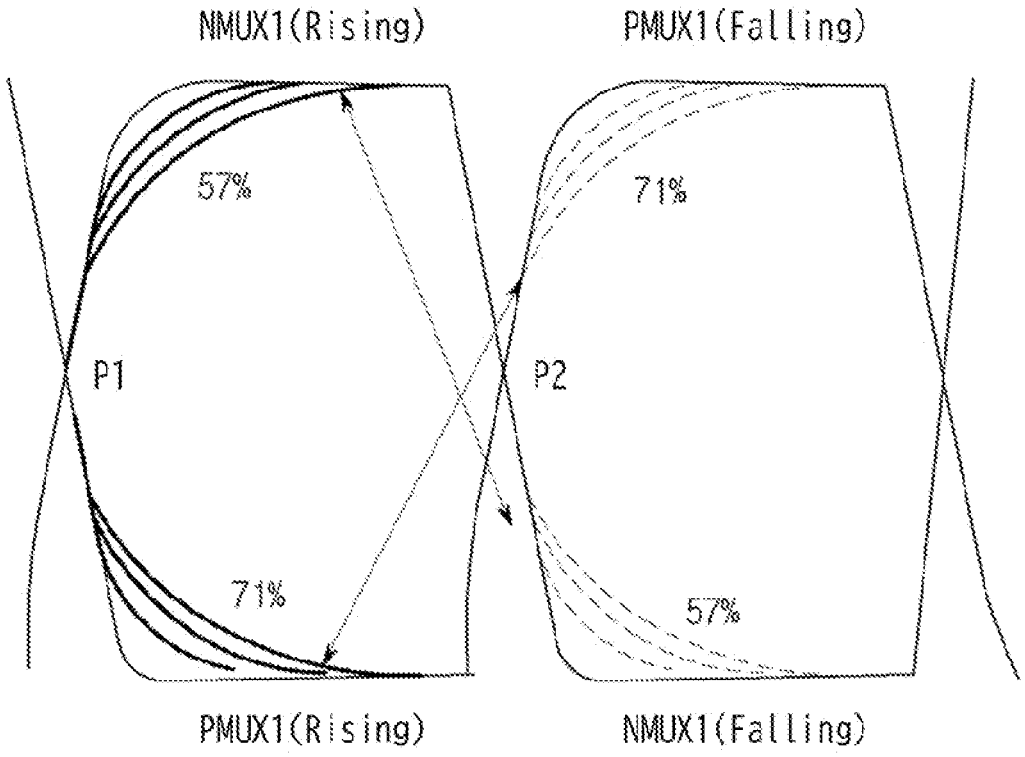
FIGS. 3A and 3B are graphs illustrating a method of controlling a slew rate of a MUX clock.
Figure 3B:
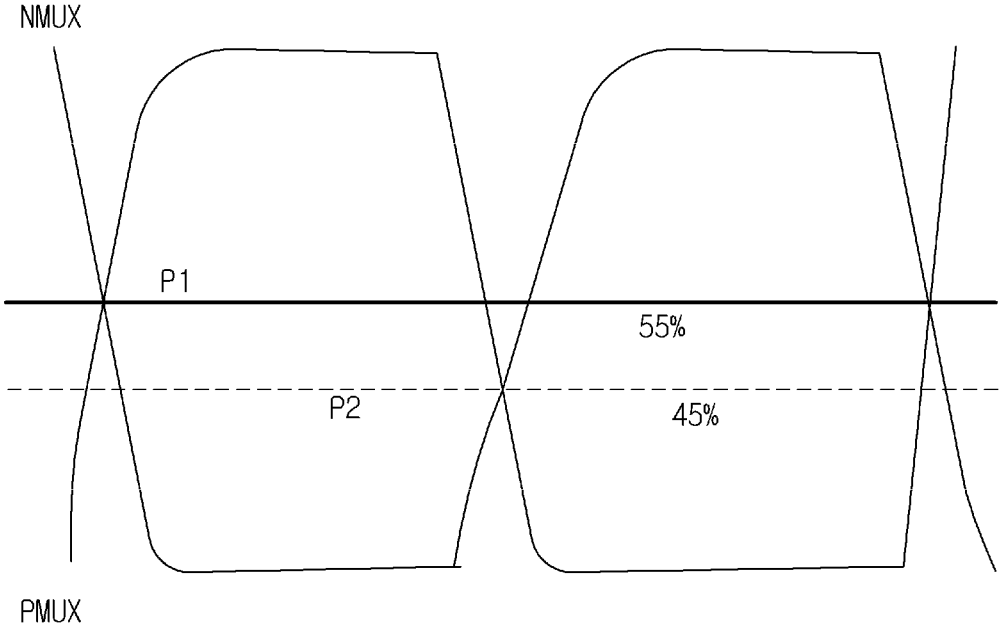

FIGS. 3A and 3B are graphs illustrating a method of controlling a slew rate of a MUX clock.

Referring to FIG. 3A first, it is illustrated that a positive MUX clock PMUX1 and a negative MUX clock NMUX1, which are complementary to each other, transition at respective slew rates. For example, it is shown that the positive MUX clock PMUX1 has a slew rate of 57%, and the negative MUX clock NMUX1 has a slew rate of 71%.

The above-mentioned "slew rate of 57%" preferably means that falling or rising is performed at a rate of 57% of the maximum slew rate that the positive MUX clock PMUX1 can have, for example. However, such a ratio is a mere example and the present invention is not limited thereto.

In FIG. 3A, the positive MUX clock PMUX1 and the negative MUX clock NMUX1 have two crossing points P1 and P2. The first crossing point P1 occurs in a case where the positive MUX clock PMUX1 is falling and the negative MUX clock NMUX1 is rising, and the second crossing point P2 occurs in a case where the positive MUX clock PMUX1 is rising and the negative MUX clock NMUX1 is falling.

EMI noise due to a current generated during switching of the MUX tends to be canceled out and thus reduced, as the two crossing points occur at the same point. It is necessary to adjust a rising/falling slew rate of the positive MUX clock PMUX1 and the negative MUX clock NMUX1 to maintain the ideal case as shown in FIG. 3A.

Meanwhile, as illustrated in FIG. 3B, when two crossing points of the MUX clock signal occur at a 55% point P1 and a 45% point P2 of the total voltage, respectively, it is difficult to expect the effect of canceling EMI noise due to a difference in voltage levels.

However, in order to adjust the slew rate of the positive MUX clock PMUX1, it is difficult to make the crossing points P1 and P2 coincide only by adjusting the rising/falling slew rate in a collective manner. This is because the slew rates of the positive MUX clock PMUX1 and the negative MUX clock NMUX1 are different from each other, and the voltage transition speeds to which the slew rates are applied are also different from each other.

Therefore, in order to obtain an effective EMI noise canceling effect between the positive MUX clock PMUX1 and the negative MUX clock NMUX1, it is necessary to adjust the slew rate at each of the rising/falling time of the positive MUX clock PMUX1, and adjust the slew rate at each of the rising/falling time of the negative MUX clock NMUX1.

Figure 4:
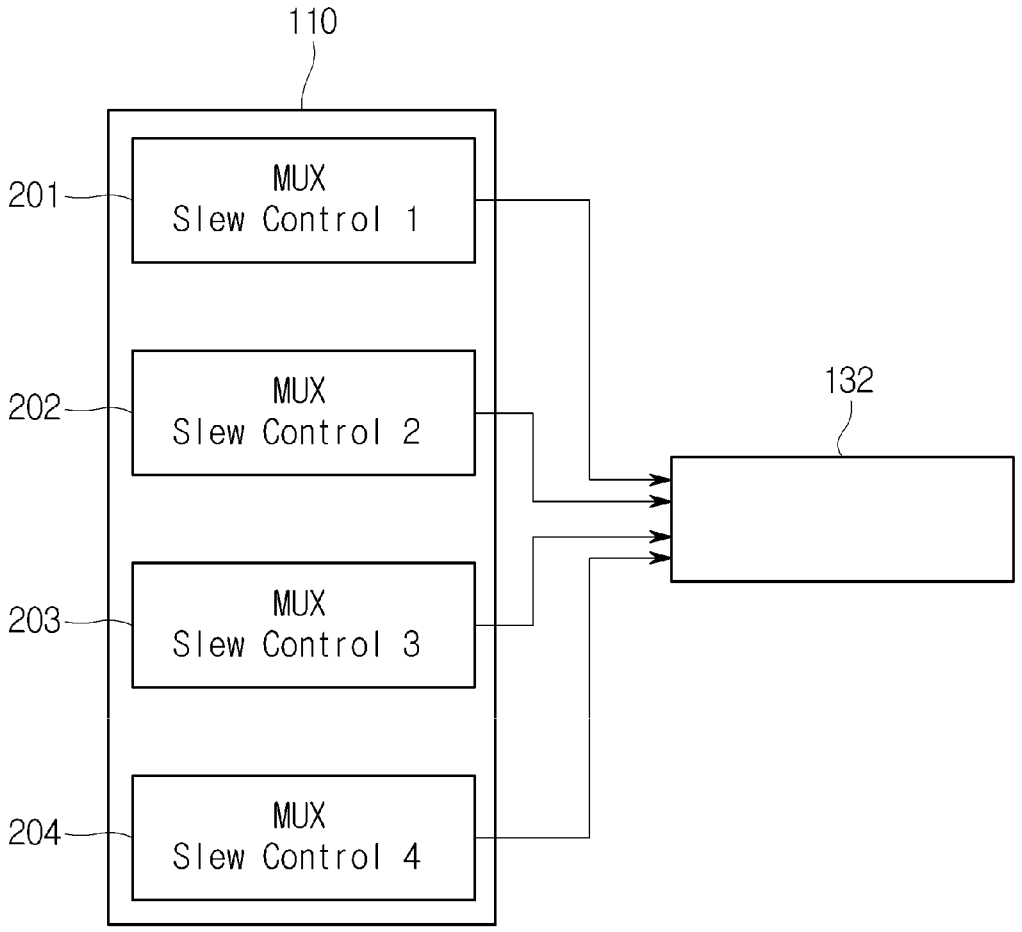
FIG. 4 is a block diagram illustrating an operation of a timing controller according to embodiments of the present invention.

FIG. 4 is a block diagram illustrating slew rate control units 201 to 204 included in the timing controller 110 according to some embodiments of the present invention.

Referring to FIG. 4, the timing controller 110 includes first to fourth slew rate control units 201 to 204 for adjusting a slew rate between a positive MUX clock PMUX1 and a negative MUX clock NMUX1.

As described above, the first to fourth slew rate control units 201 to 204 each include a circuit configuration for adjusting the slew rate between the positive MUX clock PMUX1 and the negative MUX clock NMUX1. For example, the first slew rate control unit 201 can control a slew rate at a rising time of the positive MUX clock PMUX1, and the second slew rate control unit 202 can control a slew rate at a rising time of the negative MUX clock NMUX1. The third slew rate control unit 203 can control a slew rate at a falling time of the positive MUX clock PMUX1, and the fourth slew rate control unit 204 can control a slew rate at a falling time of the negative MUX clock NMUX1.

The positive MUX clock PMUX1 and the negative MUX clock NMUX1 in which the slew rate is controlled can be provided to the MUX circuit 132. For example, the timing controller 110 can output a positive MUX clock PMUX1 rising from the first slew rate control unit 201, and output a positive MUX clock PMUX1 falling from the third slew rate control unit 203. For example, the first slew rate control unit 201 and the third slew rate control unit 203 can alternately operate to provide the positive MUX clock to the transmission gate TG.

Similarly, the timing controller 110 can output a negative MUX clock PMUX1 rising from the second slew rate control unit 202, and output a negative MUX clock PMUX1 falling from the third slew rate control unit 203. For example, the second slew rate control unit 202 and the fourth slew rate control unit 204 can alternately operate to provide the negative MUX clock to the transmission gate TG.

Figure 5:
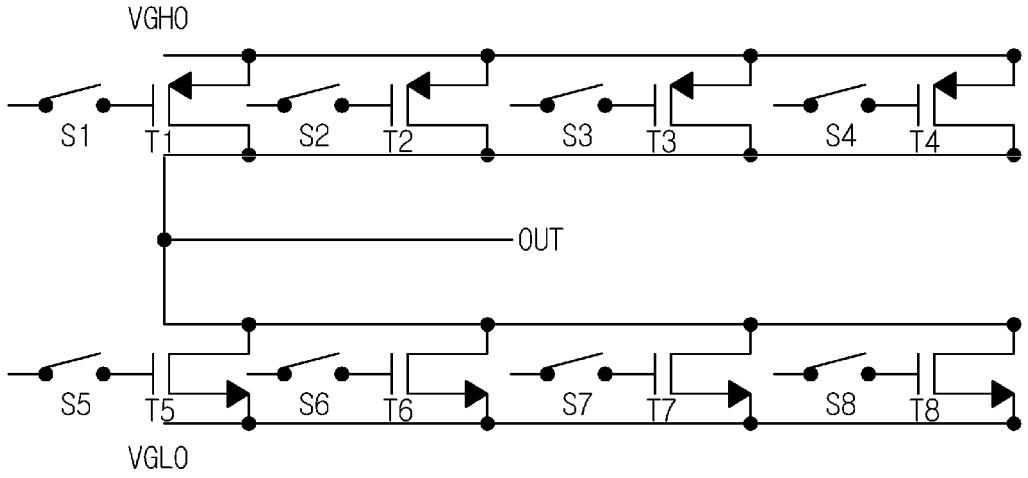
FIG. 5 is an exemplary circuit diagram illustrating a slew rate control unit according to an embodiment of the present disclosure.

FIG. 5 is an exemplary circuit diagram illustrating a slew rate control unit. The configuration shown in FIG. 5 can be used in one or more slew rate control units shown in FIG. 4.

Referring to FIG. 5, as an example, the first slew rate control unit 201 can include first to eighth transistors T1 to T8, switches S1 to S4 for switching each transistor, a high potential voltage line VGHO to which a high-level high potential voltage is supplied, and low potential voltage line VGLO to which a low-level low potential voltage is supplied.

The first to fourth transistors T1 to T4 are connected to the high potential voltage line VGHO. The first to fourth transistors T1 to T4 can provide the high potential voltage to the output terminal OUT according to a control signal provided to the first to fourth switches S1 to S4.

In some embodiments of the present invention, the positive MUX clock PMUX or the negative MUX clock NMUX are output to the output terminal OUT of the slew rate control unit. Therefore, the slew rate of each of the positive MUX clock PMUX or the negative MUX clock NMUX can be determined by the control of the first to fourth switches S1 to S4.

Specifically, when the first to eighth transistors T1 to T8 are turned on under the control of the first to fourth switches S1 to S8, a time constant $\tau$ changes in overall circuits of the slew rate control unit. Therefore, according to how many of the first to eighth transistors T1 to T8 are turned on, a slew rate of a MUX clock provided by the corresponding slew rate control unit changes.

According to an embodiment of the present invention, each of the first to fourth slew rate control units 201 to 204 included in the display device can change a time constant of a circuit included therein according to a turn-on state of a transistor included therein, to control a slew rate of a MUX clock output from the circuit.

The slew rate control unit illustrated in FIG. 5 is exemplary, and the number of transistors included in the slew rate control unit is not limited to four. For example, when a slew rate control unit includes eight transistors, the slew rate control unit can be capable of adjusting a time constant in eight steps and controlling the slew rate through the same.

Figure 6A:
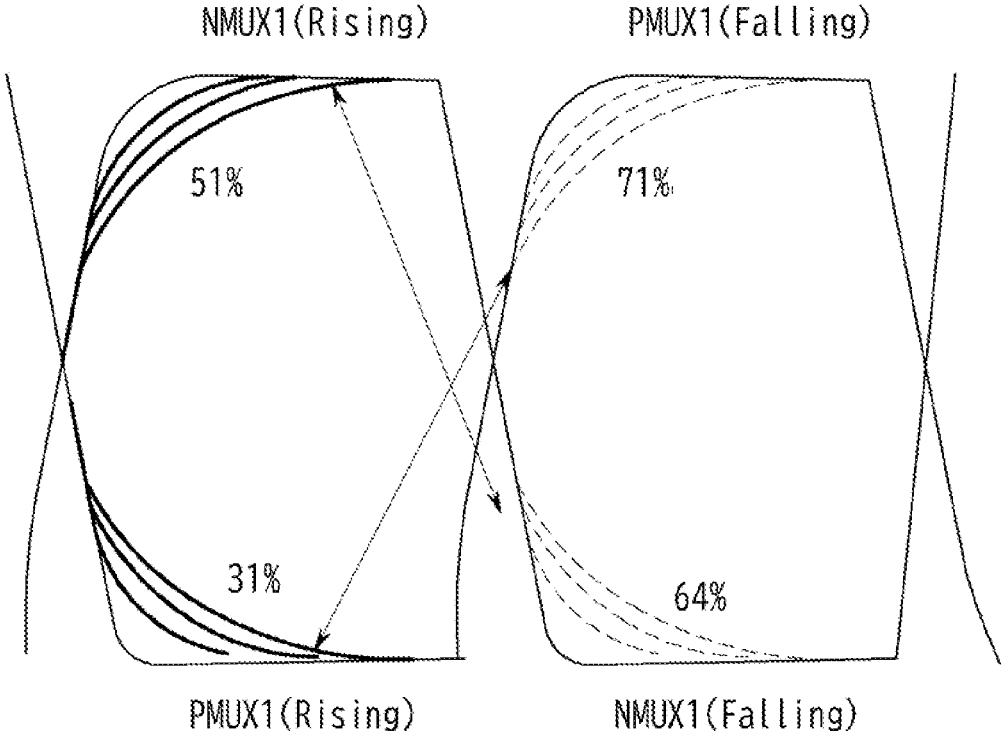
FIGS. 6A and 6B are graphs illustrating a slew rate control method of a MUX clock.
Figure 6B:
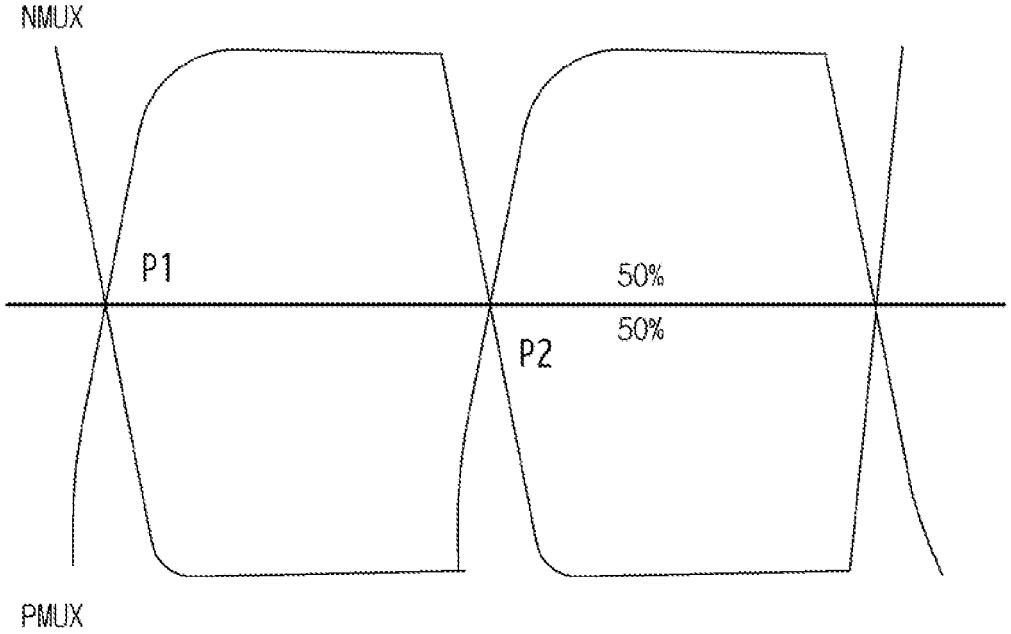

FIGS. 6A and 6B are graphs illustrating a slew rate control method of a MUX clock.

Referring to FIG. 6A, an example in which the slew rate of each signal is controlled is illustrated, so that a slew rate of a rising section is 51% and the slew rate of the falling section is 64% in the negative MUX clock NMUX1, and the slew rate of the rising section is 71% and the slew rate of the falling section is 31% in the positive MUX clock PMUX1. As described above, the display device according to an embodiment of the present invention can control the slew rate of the MUX clock using four slew rate control units (e.g., elements 201-204 shown in FIG. 4), each of which can control a time constant.

Referring to FIG. 6B, the timing controller 110 including the slew rate control unit(s) can measure intersection points at which MUX clocks intersect each other. For example, the timing controller 110 can measure a first crossing point P1 between the rising positive MUX clock PMUX1 and the falling negative MUX clock NMUX1, and a second crossing point P2 between the falling positive MUX clock PMUX1 and the rising negative MUX clock NMUX. When a difference between the two crossing points is equal to or greater than a predetermined amount, the timing controller 110 can perform control for the slew rate of each of the positive MUX clock PMUX1 and the negative MUX clock NMUX1.

Those of ordinary skill in the art to which the present invention pertains will appreciate that the present invention can be implemented in other specific forms without changing its technical spirit or essential features. Therefore, it should be understood that the embodiments described above are illustrative in all respects and not restrictive. It should be construed that the scope of the invention is indicated by the scope of the claims, which will be described later, rather than by the detailed description above, and all changes or modified forms derived from the meaning and scope of the claims and equivalent concepts thereof are included in the scope of the present invention.

What is claimed is:

1. A display device, comprising:

a display panel including a plurality of pixels defined by allowing a plurality of gate lines and a plurality of data lines to intersect each other;

a timing controller configured to generate a gate control signal, a data control signal, a multiplexer (MUX) clock signal, and image data;

a gate driving circuit configured to sequentially provide gate signals to the plurality of gate lines based on the gate control signal;

a data driving circuit configured to supply a data signal to the plurality of data lines based on the image data and the data control signal to drive the plurality of pixels; and a MUX circuit configured to receive the data signal and output the data signal in a time division manner to the plurality of data lines according to the MUX clock signal, wherein the timing controller includes a slew rate control unit that controls a slew rate of the MUX clock signal, in which the slew rate control unit includes:

a rising slew rate control unit configured to control the slew rate in a rising section of the MUX clock signal, and a falling slew rate control unit configured to control the slew rate in a falling section of the MUX clock signal.

2. The display device of claim 1, wherein the MUX clock signal includes a positive MUX clock signal and a negative MUX clock signal that is complementary to the positive MUX clock signal, and wherein the MUX circuit includes a plurality of transmission gates that are switched according to the positive MUX clock signal and the negative MUX clock signal.

3. The display device of claim 2, wherein the rising slew rate control unit includes:

a first circuit configured to control the slew rate in a rising section of the positive MUX clock signal; and a second circuit configured to control the slew rate in a rising section of the negative MUX clock signal, and wherein the falling slew rate control unit includes:

a third circuit configured to control the slew rate in a falling section of the positive MUX clock signal; and a fourth circuit configured to control the slew rate in a falling section of the negative MUX clock signal.

4. The display device of claim 3, wherein the timing controller measures a first intersection point and a second intersection point at which the positive MUX clock signal and the negative MUX clock signal intersect each other, and wherein the timing controller controls the slew rate in the rising section and the slew rate in the falling section of the positive MUX clock signal, and the slew rate in the rising section and the slew rate in the falling section of the negative MUX clock signal, so that the first intersection point and the second intersection point meet at the same voltage.

5. The display device of claim 1, wherein the slew rate control unit includes:

a high potential voltage line and a low potential voltage line arranged side by side;

at least one first transistor pulling up an output terminal to the high potential voltage according to a first switching signal; and at least one second transistor pulling down the output terminal to the low potential voltage according to a second switching signal.

6. A method of driving a display panel, the method comprising:

generating a gate control signal, a data control signal, and a multiplexer (MUX) clock signal;

generating a data signal provided to a plurality of data lines based on the data control signal;

providing the data signal to a MUX circuit;

outputting the data signal in a time division manner based on the MUX clock signal; and controlling a slew rate at a rising time and a slew rate at a falling time of the MUX clock signal to be provided to the MUX circuit.

7. The method of claim 6, wherein the MUX clock signal includes a positive MUX clock signal and a negative MUX clock signal that is complementary to the positive MUX clock signal, and wherein the MUX circuit includes a plurality of transmission gates that are switched according to the positive MUX clock signal and the negative MUX clock signal.

8. The method of claim 7, further comprising:

measuring a first intersection point and a second intersection point at which the positive MUX clock signal and the negative MUX clock signal intersect each other; and controlling a slew rate in a rising section and a slew rate in the falling section of the positive MUX clock signal, and a slew rate in the rising section and a slew rate in the falling section of the negative MUX clock signal, so that the first intersection point and the second intersection point meet at the same voltage.

* * * * *